US008459732B2

(12) United States Patent
LaPointe et al.

(10) Patent No.: US 8,459,732 B2
(45) Date of Patent: Jun. 11, 2013

(54) POWER ACTUATED ROCKING FURNITURE MECHANISM

(75) Inventors: Larry P. LaPointe, Temperance, MI (US); Chad E. Adams, Perrysburg, OH (US); Eric B. Harwood, Toledo, OH (US); Richard E. Marshall, Monroe, MI (US); Michael R. Mero, Jr., Monroe, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 517 days.

(21) Appl. No.: 12/759,184

(22) Filed: Apr. 13, 2010

(65) Prior Publication Data

US 2011/0248547 A1 Oct. 13, 2011

(51) Int. Cl.
*A47C 1/031* (2006.01)

(52) U.S. Cl.
USPC ..... 297/85 M; 297/260.2

(58) Field of Classification Search
USPC ..... 297/85 M, 260.2, 330
See application file for complete search history.

(56) References Cited

U.S. PATENT DOCUMENTS

| | | | |
|---|---|---|---|
| 3,138,402 | A | 6/1964 | Heyl, Jr. et al. |
| 3,338,632 | A | 8/1967 | Kleinsorge |
| 3,343,871 | A | 9/1967 | Yates et al. |
| 3,588,170 | A | 6/1971 | Knabusch et al. |
| 4,007,960 | A | 2/1977 | Gaffney |
| 4,386,803 | A | 6/1983 | Gilderbloom |
| 4,637,652 | A | 1/1987 | Bergenwall |
| 4,722,566 | A | 2/1988 | Castellini |
| 4,852,939 | A | 8/1989 | Krauska |
| 4,993,777 | A | 2/1991 | LaPointe |
| 5,024,486 | A | 6/1991 | Auel |
| 5,061,010 | A | 10/1991 | LaPointe |
| 5,165,753 | A | 11/1992 | Henderson |
| 5,215,351 | A | 6/1993 | LaPointe |
| 5,288,126 | A | 2/1994 | Saul et al. |
| 5,312,153 | A | 5/1994 | Lin |
| 5,314,238 | A | 5/1994 | Komorowski et al. |
| 5,466,046 | A | 11/1995 | Komorowski et al. |
| 5,482,350 | A | 1/1996 | Komorowski et al. |
| 5,651,580 | A | 7/1997 | LaPointe et al. |
| 5,730,494 | A | 3/1998 | LaPointe et al. |
| 5,806,920 | A | 9/1998 | Blount |
| 5,823,621 | A | 10/1998 | Broadhead |
| 5,992,931 | A | 11/1999 | LaPointe et al. |

(Continued)

FOREIGN PATENT DOCUMENTS

| | | |
|---|---|---|
| DE | 29812763 | 9/1998 |
| EP | 0218502 | 4/1987 |

(Continued)

*Primary Examiner* — Anthony D Barfield
(74) *Attorney, Agent, or Firm* — Harness, Dickey & Pierce, P.L.C.

(57) ABSTRACT

A rocking furniture member having an electrically powered actuation mechanism includes a frame and an actuation mechanism connected to the frame. The actuation mechanism includes an extendable and retractable leg rest assembly. A drive assembly connected to the actuation mechanism having an electric motor operates to move the leg rest assembly between a retracted position and any of a plurality of extended positions inclusive including a fully extended position by a command provided by an occupant of the furniture member. A rotation member connecting the actuation mechanism to the frame permits an occupant induced rocking motion of the actuation mechanism with respect to the frame at least when the leg rest assembly is in the retracted position.

19 Claims, 12 Drawing Sheets

U.S. PATENT DOCUMENTS

| | | | | |
|---|---|---|---|---|
| 6,557,940 | B2 | 5/2003 | Hayaski et al. | |
| 6,871,910 | B2 | 3/2005 | Hale | |
| 6,896,323 | B2 * | 5/2005 | LaPointe et al. | 297/85 M X |
| 7,090,297 | B2 | 8/2006 | Mohn et al. | |
| 8,016,348 | B2 * | 9/2011 | Hoffman et al. | 297/85 M |
| 8,113,574 | B2 * | 2/2012 | Hoffman et al. | 297/85 M |
| 8,123,288 | B2 * | 2/2012 | Murphy et al. | 297/85 M X |
| 2002/0125751 | A1 | 9/2002 | Bullard | |
| 2007/0132292 | A1 | 6/2007 | Robertson | |

FOREIGN PATENT DOCUMENTS

| | | |
|---|---|---|
| GB | 1123441 | 8/1968 |
| GB | 1497973 | 1/1978 |
| GB | 2380399 | 4/2003 |
| GB | 2436474 | 9/2007 |
| GB | 2436475 | 9/2007 |
| GB | 2436749 | 10/2007 |

* cited by examiner

POWER ACTUATED ROCKING FURNITURE MECHANISM

FIELD

The present disclosure relates to furniture member operating mechanisms and to a device and method for operating a reclining furniture member mechanism.

BACKGROUND

This section provides background information related to the present disclosure which is not necessarily prior art.

Conventionally, reclining articles of furniture (i.e., chairs, sofas, loveseats, and the like) require a mechanism to bias a leg rest assembly in the extended and stowed positions. Known mechanisms commonly include a large number of moving parts that tends to increase the manufacturing time and costs associated with the furniture.

Most reclining rocking chairs include an upholstered chair frame supported from a stationary base assembly in a manner permitting the chair frame to "rock" freely with respect to the base assembly. In order to provide enhanced comfort and convenience, many rocking chairs also include a "reclinable" seat assembly and/or an "extensible" leg rest assembly. For example, combination platform rocking/reclining chairs, as disclosed in Applicant's U.S. Pat. Nos. 3,096,121 and 4,179,157, permit reclining movement of the seat assembly and actuation of the leg rest assembly independently of the conventional "rocking" action. The leg rest assembly is operably coupled to a drive mechanism to permit the seat occupant to selectively move the leg rest assembly between its normally retracted (i.e., "stowed") and elevated (i.e., "extended") positions. The drive mechanism is manually-operated and includes a handle which, when rotated by the seat occupant, causes concurrent rotation of a drive rod for extending or retracting the leg rest assembly. Disadvantages of known mechanisms for providing these functions include a large quantity of parts and their requirement of one or several spring biasing elements to permit retraction of the various chair components from their extended positions.

As an additional comfort feature, a latching mechanism may also be provided for releasably retaining the chair frame in one or more rearwardly rocked or "tilted" positions on the base assembly following extension of the leg rest assembly towards its extended position. In this manner, normal "rocking" action of the rocking chair is inhibited until the leg rest assembly is returned to its normally "stowed" position. Known leg rest mechanisms also provide multiple functional positions, which can be reached using a detente mechanism, which temporarily holds the leg rest at each successive position.

SUMMARY

This section provides a general summary of the disclosure, and is not a comprehensive disclosure of its full scope or all of its features.

According to several embodiments, a rocking furniture member having an electrically powered actuation mechanism includes a frame. An actuation mechanism is connected to the frame, the actuation mechanism including an extendable and retractable leg rest assembly. An electrically powered drive assembly is connected to the actuation mechanism operating to move the leg rest assembly between retracted and extended positions. A rotation member is positioned between the actuation mechanism and the frame permitting an occupant induced rocking motion of the actuation mechanism with respect to the frame at least when the leg rest assembly is in the retracted position.

According to additional embodiments, a rocking furniture member having an electrically powered actuation mechanism includes a frame and an actuation mechanism connected to the frame. The actuation mechanism includes an extendable and retractable leg rest assembly. A drive assembly connected to the actuation mechanism having an electric motor operates to move the leg rest assembly between a retracted position and any of a plurality of extended positions inclusive including a fully extended position by a command provided by an occupant of the furniture member. A rotation member connecting the actuation mechanism to the frame permits an occupant induced rocking motion of the actuation mechanism with respect to the frame at least when the leg rest assembly is in the retracted position.

According to still further embodiments, a rocking furniture member having an actuation mechanism includes a frame and an actuation mechanism connected to the frame. The actuation mechanism includes a leg rest assembly movable between a fully retracted and a plurality of extended positions inclusive, including a fully extended position. A pantograph link of the leg rest assembly is rotatably connected to the mechanism. The pantograph link includes an engagement slot. An engagement pin is connected to an extension link. The engagement pin is releasably received in the engagement slot to extend and retract the pantograph link and thereby the leg rest assembly when the extension link is displaced. When an obstruction item in a return path of the leg rest assembly returning toward the fully retracted position is contacted, an orientation of the engagement slot permits release of the engagement pin from the engagement slot allowing the leg rest assembly to return by gravity toward the fully retracted position after removal of the obstruction item from the return path. A rotation member connects the actuation mechanism to the frame permitting an occupant induced rocking motion of the actuation mechanism with respect to the frame at least when the leg rest assembly is in the retracted position.

According to yet further embodiments a rocking furniture member includes an actuation mechanism including an extendable and retractable leg rest assembly. An electrically powered and occupant controlled drive assembly connected to the actuation mechanism operates upon receipt of a command from an occupant to move the leg rest assembly between a retracted position and any of a plurality of extended positions inclusive including a fully extended position. A pantograph link of the leg rest assembly is rotatably connected to the mechanism. The pantograph link has an engagement slot. An engagement pin connected to an extension link is releasably received in the engagement slot during powered extension and retraction of the leg rest assembly. When an obstruction item in a return path of the leg rest assembly toward the retracted position is contacted, the engagement pin is released from the engagement slot allowing the leg rest assembly to return by gravity toward the retracted position after removal of the obstruction item from the return path. An elastically deflectable polymeric material rotation member is connected to the actuation mechanism permitting an occupant induced rocking motion of the actuation mechanism at least when the leg rest assembly is in the retracted position.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
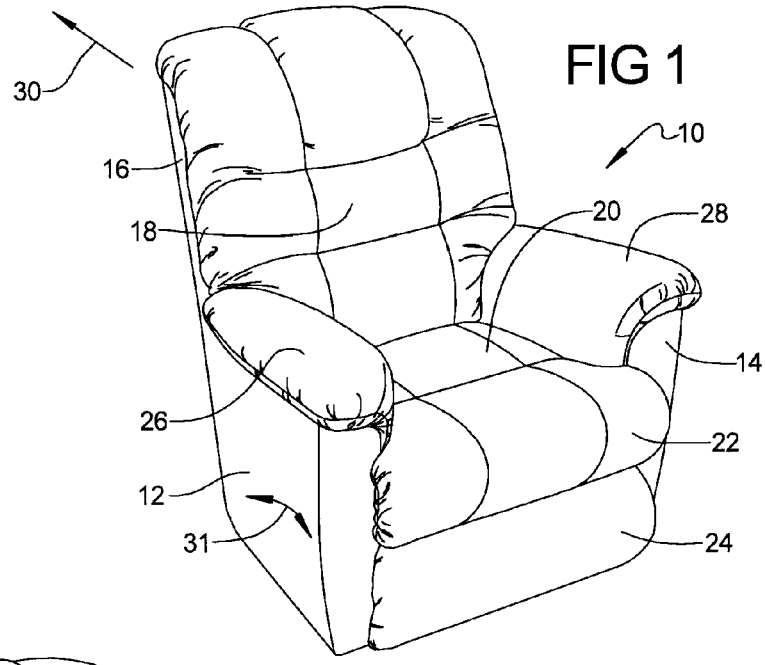
FIG. 1 is a front perspective view of a furniture member having an in-line linkage mechanism of the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring generally to FIG. 1, a furniture member 10 depicted as a reclining chair includes first and second sides 12, 14 and an occupant seat back 16 covered with a seat back cushion assembly 18. An occupant support member 20 is suspended between the first and second sides 12, 14 and a padded leg support 22 is also provided. A padded, extendable leg rest assembly 24 is also provided. First and second arm rest pads 26, 28 can be used to cover the upper surfaces of the first and second sides 12, 14 respectively. An occupant's weight generally centered on support member 20 is normally operable to maintain seat back 16 in an upright position. When the leg rest assembly 24 is positioned in a stowed or retracted position shown, seat back 16 cannot be manually reclined or rotated with respect to a seat back arc of rotation 30. Seat back 16 rotates about arc of rotation 30 only after leg rest assembly 24 reaches a fully extended position shown and described with reference to FIGS. 12 and 13. Seat back 16 returns to the upright position shown and opposite to seat back arc of rotation 30 when a command is given by the occupant to return leg rest assembly 24 from a fully extended position to the fully retracted position shown.

According several embodiments, furniture member 10 can independently rotate or rock about a furniture member arc of rotation 31 by motion of the occupant and without requiring powered operation. In the embodiment shown, furniture member 10 is depicted as a chair however the present teachings are not limited to chairs. Furniture member 10 can be any of a plurality of furniture members, including, but not limited to single or multiple person furniture members, sofas, sectional members and/or loveseats.

Figure 2:
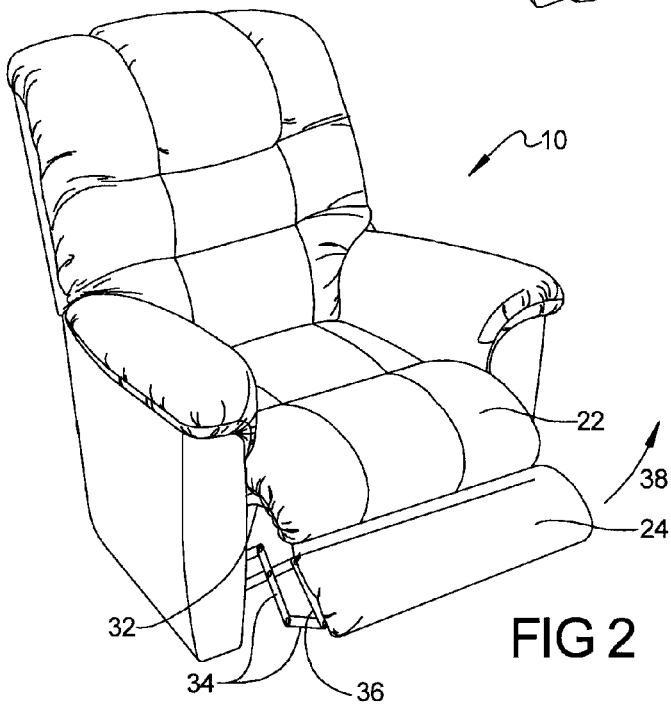
FIG. 2 is a front perspective view of the furniture member of FIG. 1 having a leg rest assembly shown in an extended position.

Referring generally to FIG. 2, an actuation mechanism 32 can be automatically actuated by command from the occupant to direct the repositioning of leg rest assembly 24 from the stowed position (shown in FIG. 1) to an extended position. Actuation mechanism 32 supports and permits both extension and retraction of leg rest assembly 24, as well as rotation of seat back 16. More specifically, actuation mechanism 32 includes first and second pantograph linkage sets 34, 35 (second pantograph linkage set 35 is not visible in this view) which are linked to leg rest assembly 24 using first and second leg rest support arms 36, 37 (only first leg rest support arm 36 is visible in this view). Leg rest assembly 24 can be moved from the fully retracted position (shown in FIG. 1) to an extended position by motion of the leg rest assembly 24 about an extension arc 38. It will be apparent that rotation of leg rest assembly 24 in an opposite direction from extension arc 38 will return the leg rest assembly 24 to the retracted position.

Figure 3:
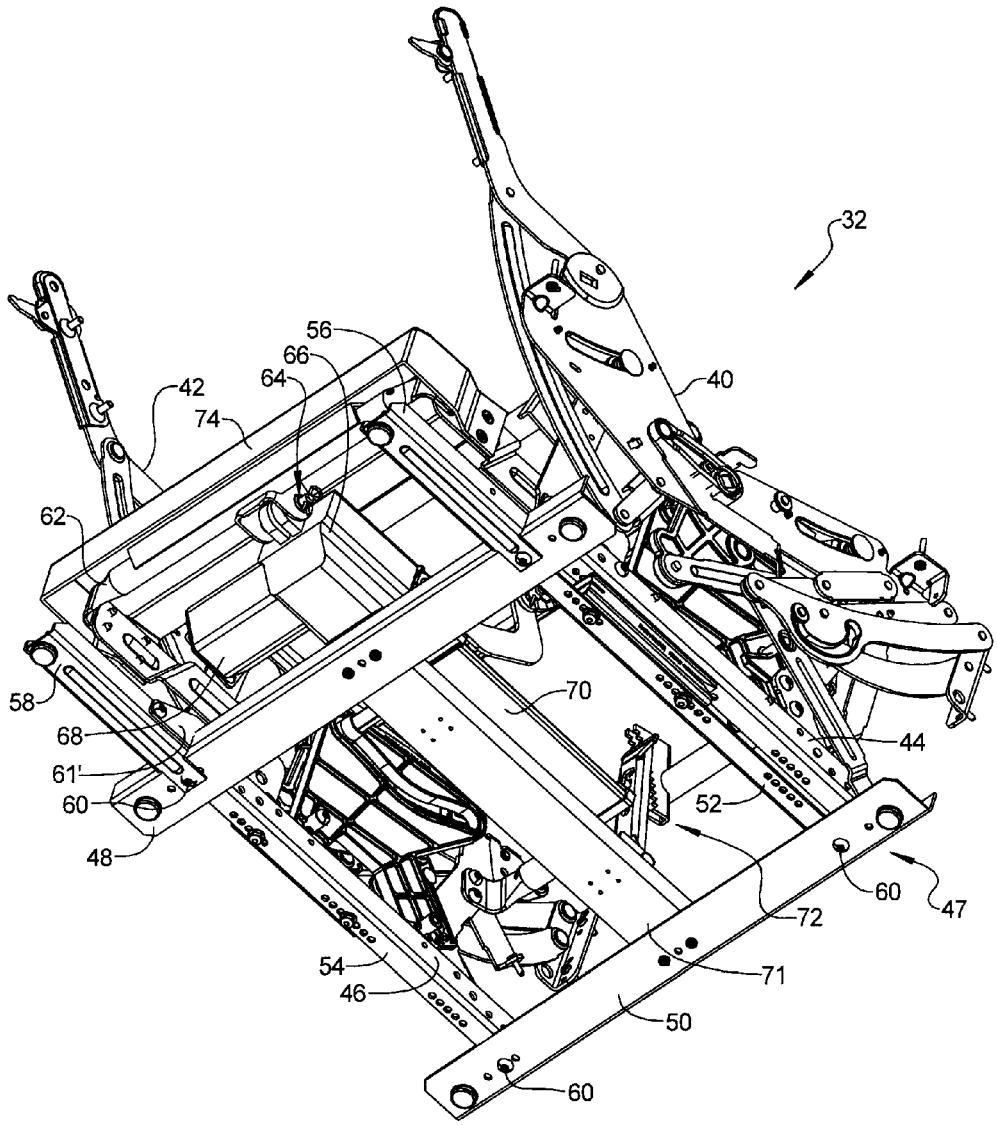
FIG. 3 is a bottom right perspective view of the mechanism of the present disclosure.

Referring to FIG. 3, the functional and structural aspects of actuation mechanism 32 for use in either single or multi-person furniture members 10 is shown. For purposes of clarity, FIG. 3 shows the various pre-assembled frame components with their upholstery, padding, etc. removed to better illustrate the interdependency of the mechanism components' construction which can be rapidly and efficiently assembled. Therefore, all of the mechanism components can be individually fabricated or sub-assembled to include the requisite brackets, springs, padding and upholstery on an "off-line" batch-type basis. Thereafter, the various pre-assembled and upholstered furniture components are assembled for totally integrating actuation mechanism 32 therein.

Actuation mechanism 32 provides multiple features which will each be separately described, including: 1) a linkage portion; 2) a motor and gear system to permit powered operation of furniture member 10; 3) a ratchet and pawl feature which retains the leg rest assembly 24 in multiple extended positions without the biasing force of spring elements; and 4) an operation control system that permits independent automatic operation of leg rest assembly 24 and seat back 16.

As generally used herein, the terms front or forward and right hand or left hand are oriented with respect to the direction an occupant of the furniture member 10 faces when seated or with respect to the occupant's sides when the occupant is seated. The terms rear or rearward refer to a direction opposite to the front or forward direction. The linkage portion of actuation mechanism 32 includes right and left side assemblies 40, 42, which are connected to and supported on right and left side support members 44, 46. Right and left side support members 44, 46 are themselves rotatably connected to a frame support structure 47 such that right and left side support members 44, 46 and right and left side assemblies 40, 42 can collectively and/or independently move with respect to frame support structure 47.

Frame support structure 47 includes multiple frame members including rear and front cross frame members 48, 50, right and left lateral frame members 52, 54, and right and left frame extensions 56, 58. Occupant loads at a front portion of furniture member 10 are transferred from right and left lateral frame members 52, 54 to front cross frame member 50 which is connected such as by threaded fasteners or rivets 60 to right and left lateral frame members 52, 54. Similarly, occupant loads at a rear portion of the furniture member 10 are transferred from right and left lateral frame members 52, 54 to rear cross frame member 48 which is connected such as by threaded fasteners or rivets 60 to right and left lateral frame members 52, 54. Right and left frame extensions 56, 58 are connected to rear cross frame member 48 by threaded fasteners or rivets 60 and by brackets 61, 61' (only left side bracket 61' is visible in this view). In some embodiments the frame members can each be created from formed, bent and/or extruded angle elements, of metal such as steel or aluminum, or of polymeric or composite materials. The present disclosure is not limited by the material used for the frame components.

A rear cross support member 62 connects right and left side support members 44, 46. A hinge pin assembly 64 connected to cross support member 62 rotatably supports an electrically powered and occupant controlled drive assembly 66. A motor 68 such as an AC or DC electric motor is connected to drive assembly 66 to provide powered operation of actuation mechanism 32 via drive assembly 66. A gear housing 70 can extend forward from drive assembly 66 and provide for a gear drive such as a worm drive gear. Drive assembly 66 and gear housing 70 are together freely rotatable above a central lateral frame member 71. Central lateral frame member 71 supports a portion of a ratchet and pawl assembly 72 which is also freely disposed with respect to gear housing 70. A cover member 74 is connected to right and left lateral frame members 52, 54 which at least partially covers hinge pin assembly 64, drive assembly 66 and motor 68.

Figure 4:
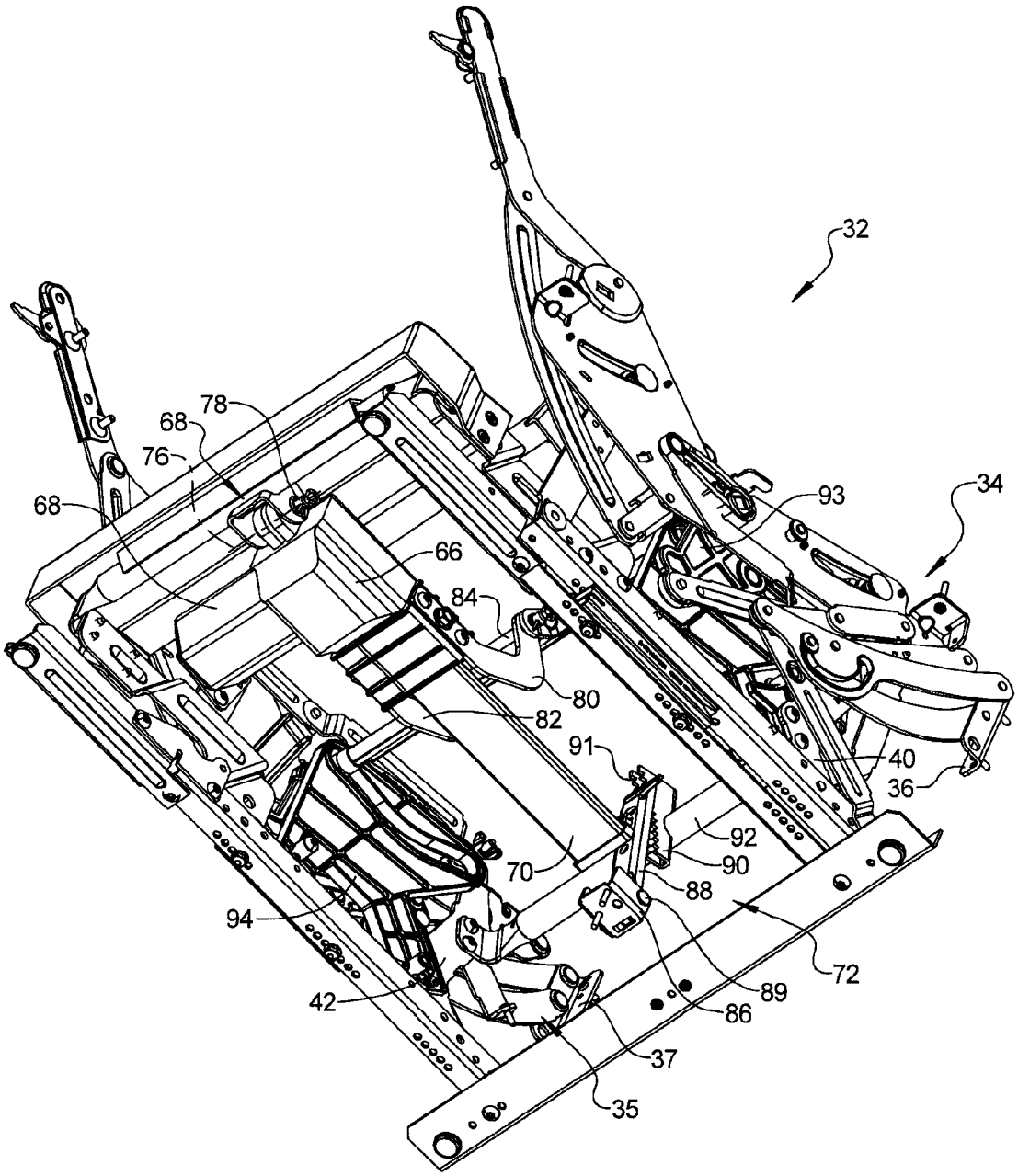
FIG. 4 is a bottom right perspective view similar to FIG. 3 further showing selected frame members removed for clarity.

Referring to FIG. 4, drive assembly 66 is rotatable about a longitudinal axis of rotation 76 defined by a hinge pin 78 rotatably received in hinge pin assembly 64. Drive assembly 66 including motor 68 and gear housing 70 rotate about longitudinal axis of rotation 76 from the position shown in FIG. 4 to an upward position or position rotated away from the viewer as viewed in FIG. 4 as the leg rest assembly 24 (only partially shown in this view as first and second leg rest support arms 36, 37) is rotated from the stowed position to an extended position. The drive assembly 66 is connected using first and second rigid drive links 80, 82 to a drive rod 84. Each of the first and second rigid drive links 80, 82 are fixedly connected to drive assembly 66.

Rocking motion of actuation mechanism 32 described with reference to FIG. 1 is precluded for any extended position of leg rest assembly 24 by engagement of ratchet and pawl assembly 72. Ratchet and pawl assembly 72 includes a pawl support bracket 86 which rotatably supports a pawl member 88 via a pivot pin 89. A ratchet 90 is fixedly connected to a front cross support member 92 fixedly connected between opposite sides of actuation mechanism 32. As leg rest assembly 24 extends, pawl member 88 engages individual teeth 91 of ratchet 90 which both prevents further rocking motion of the actuation mechanism 32 and temporarily creates a hold position of leg rest assembly 24 until a control command is given by the occupant of the furniture member to return leg rest assembly 24 from any extended position to the retracted position.

Actuation mechanism 32 further includes opposed first and second sequencing plates 93, 94, which according to several embodiments can be created such as a molding of a polymeric material such as polyoxymethylene. The material selected for first and second sequencing plates 93, 94 provides structural rigidity while also providing for reduced friction during sliding/rotating motion of drive rod 84. Material for the first and second sequencing plates 93, 94 can also be other polymeric materials or can be cast or formed from a metal material such as aluminum. First and second sequencing plates 93, 94 receive opposed ends of drive rod 84 to provide a rotational and displacement passage for drive rod 84.

Figure 5:
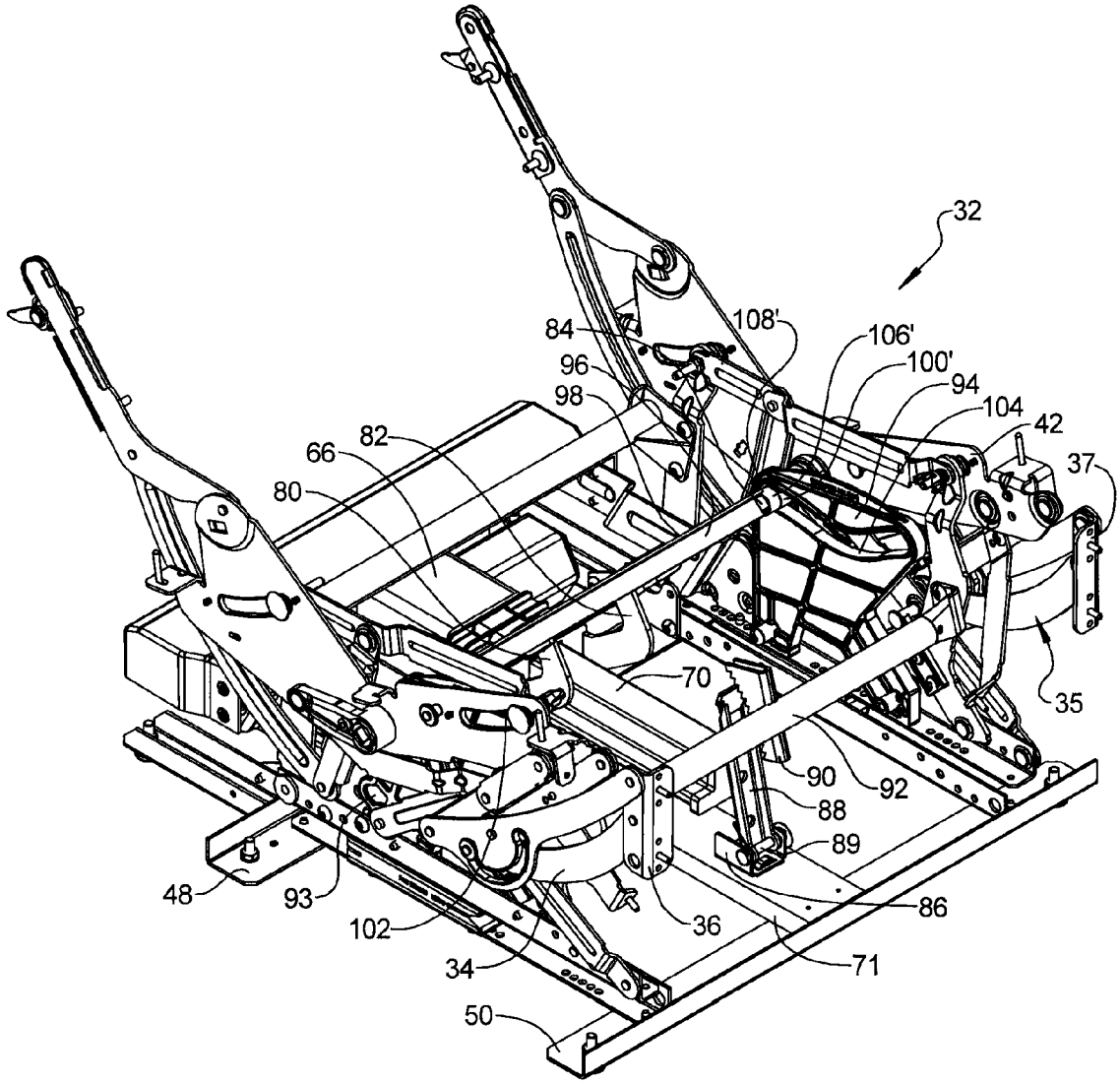
FIG. 5 is a front right perspective view of the mechanism of FIG. 3.

Referring to FIG. 5, both a rotational and a translational load is imparted to drive rod 84 by the first and second rigid drive links 80, 82, therefore drive rod 84 may be longitudinally stiffened using a reinforcing member 96 fixed, for example, by welding to drive rod 84. Reinforcing member 96 can be in the form of an L-shaped bracket having a reinforcing member leg 98. A polymeric bushing 100, 100' is attached at both opposed ends of drive rod 84. The polymeric bushings 100, 100' are individually slidably received in one of a first or second curved elongated channel 102, 104 each created in one of the first and second sequencing plates 93, 94. To align and retain the polymeric bushings 100, 100' within the first and second curved elongated channels 102, 104, a spacer member 106, 106' (spacer member 106 is not visible in this view) is positioned between each polymeric bushing 100, 100' and the reinforcing member 96. In the leg rest fully retracted position shown, each of the polymeric bushings 100, 100' and the drive rod 84 are positioned proximate to or in contact with a first channel end wall 108, 108' (first channel end wall 108 is not visible in this view) of the first and second curved elongated channels 102, 104. As clearly seen in FIG. 5, central lateral frame number 71 provides a connection location and direct support of pawl support bracket 86 and pawl member 88.

Figure 6:
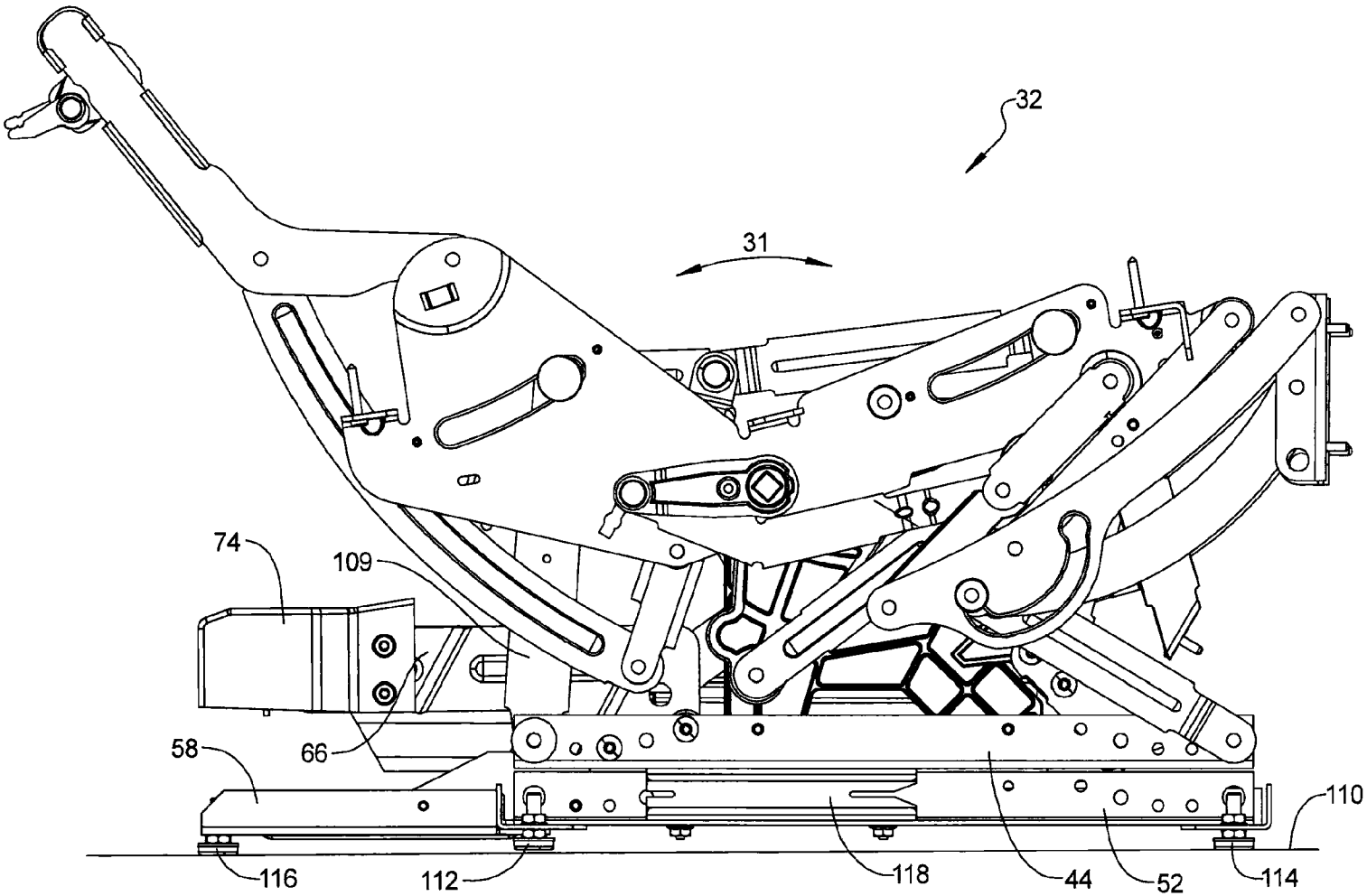
FIG. 6 is right side elevational view of the mechanism of FIG. 3.

Referring to FIG. 6, actuation mechanism 32 can be supported directly on a planar floor surface 110 using a combination of a rear adjustable height leg 112, a front adjustable height leg 114, and a frame extension adjustable height leg 116, which are each duplicated on opposite sides of the actuation mechanism 32. In order to provide for rocking motion of the actuation mechanism 32, a rocking motion biasing member 118 is connected such as by fastening between the side support members such as right side support member 44 shown and the lateral frame members such as right lateral frame member 52. Rocking motion biasing member 118 therefore provides for furniture member arc of rotation 31. As evident in FIG. 6, cover 74 extends at least partially over the rearward extension of drive assembly 66 with respect to a rear support link 109. According to several embodiments, rocking motion biasing member 118 acts as a rotation and/or biasing member for the furniture member and can be made of an elastically flexible, resilient polymeric material. According to several embodiments, rocking motion biasing member 118 is completely defined as a block shape such as a rectangle, having no coils or extending members common to coiled spring biasing members.

Figure 7:
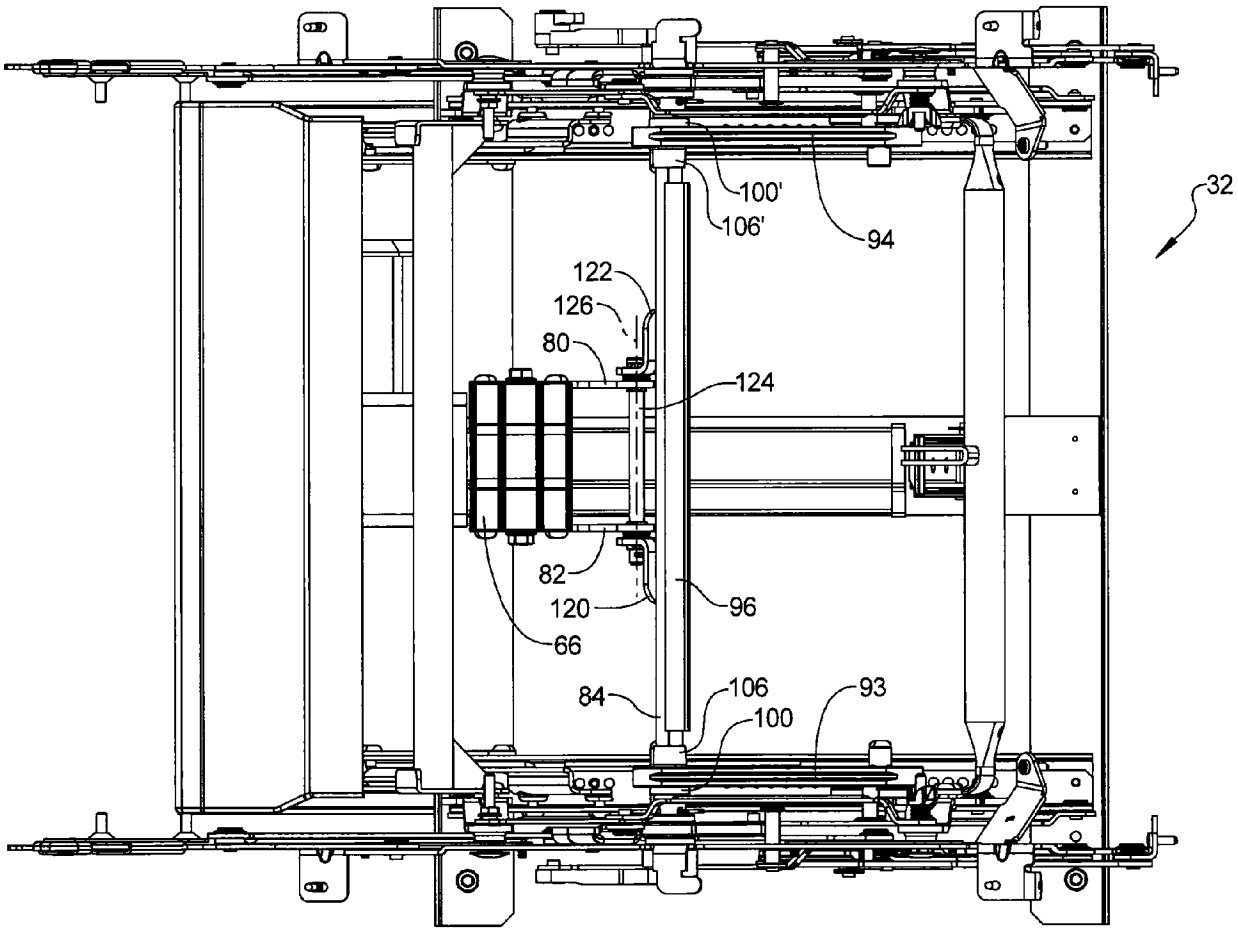
FIG. 7 is a top plan view of the mechanism of FIG. 3.

Referring to FIG. 7, as previously noted, first and second rigid drive links 80, 82 are fixedly connected to drive assembly 66. To provide for axial rotation of drive rod 84, the first and second rigid drive links 80, 82 are therefore rotationally connected to the drive rod 84 using first and second drive rod connecting links 120, 122, which are each rotatably connected to a bracket support pin 124 such that first and second drive rod connecting links 120, 122 rotate with respect to a support pin axis of rotation 126 of bracket support pin 124. Drive rod 84 can therefore axially rotate as well as translate forward and rearward in order to achieve the various extended positions and the retracted position of the leg rest assembly as well as the seat back. First and second drive rod connecting links 120, 122 are fixedly connected such as by welding or fastening to drive rod 84, therefore axial rotation of drive rod 84 is induced by the generally upward and downward rotational movement of first and second rigid drive links 80, 82 causing rotation of first and second drive rod connecting links 120, 122 with respect to bracket support pin 124.

Figure 8:
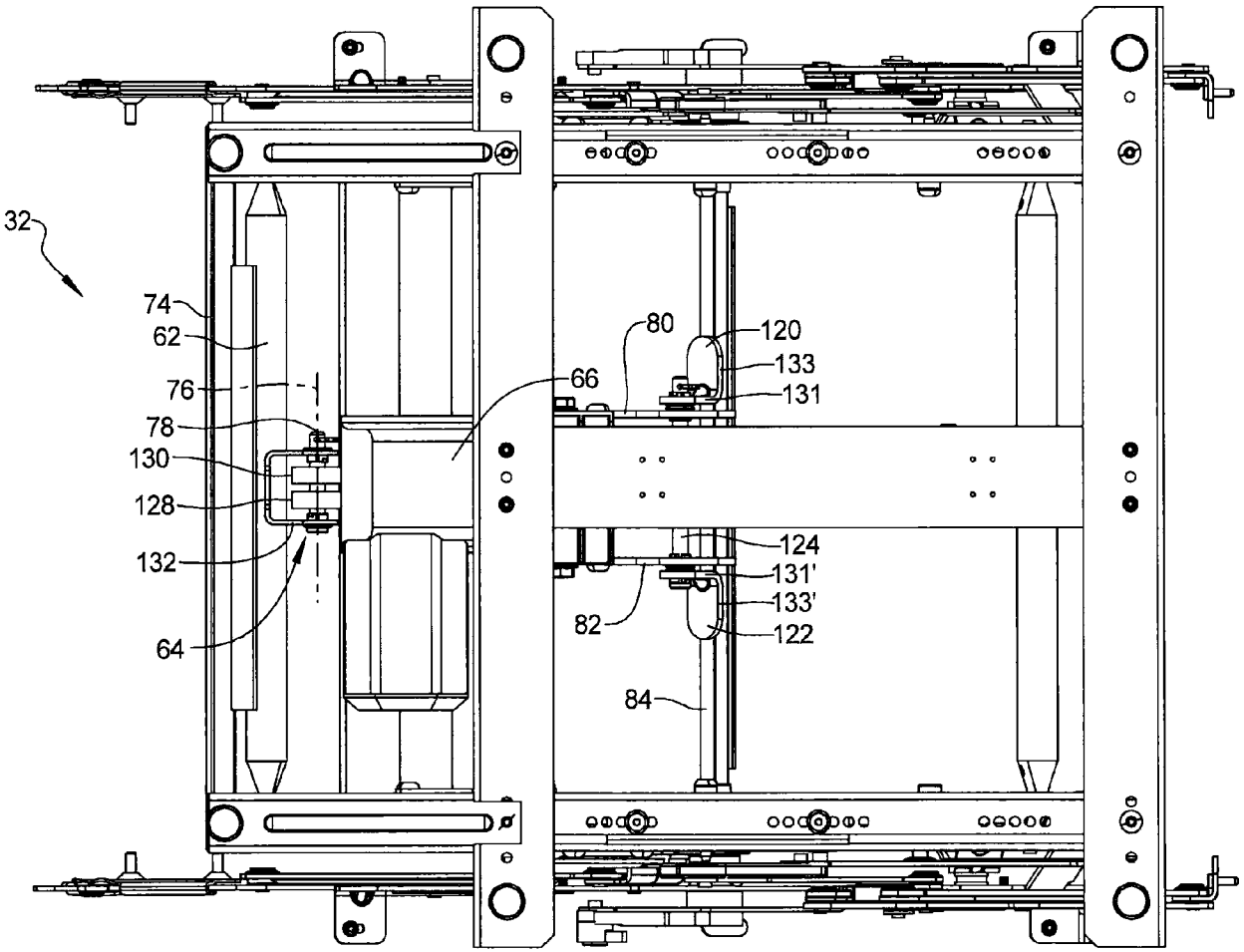
FIG. 8 is a bottom plan view of the mechanism of FIG. 3.

Referring to FIG. 8, the hinge pin assembly 64 provides for rotational connection between drive assembly 66 and rear cross support member 62. First and second support arms 128, 130 extend rearwardly from drive assembly 66, having hinge pin 78 rotatably disposed therethrough. Outward ends of hinge pin 78 are also captured by opposed bracket legs of a U-shaped bracket 132 permitting rotation about longitudinal axis of rotation 76. As more clearly evident in this view, the first and second drive rod connecting links 120, 122 can be formed as L-shaped members each having a first leg 131, 131' and a second leg 133, 133'. Bracket support pin 124 is rotatably received through the first legs 131, 131'.

Figure 9:
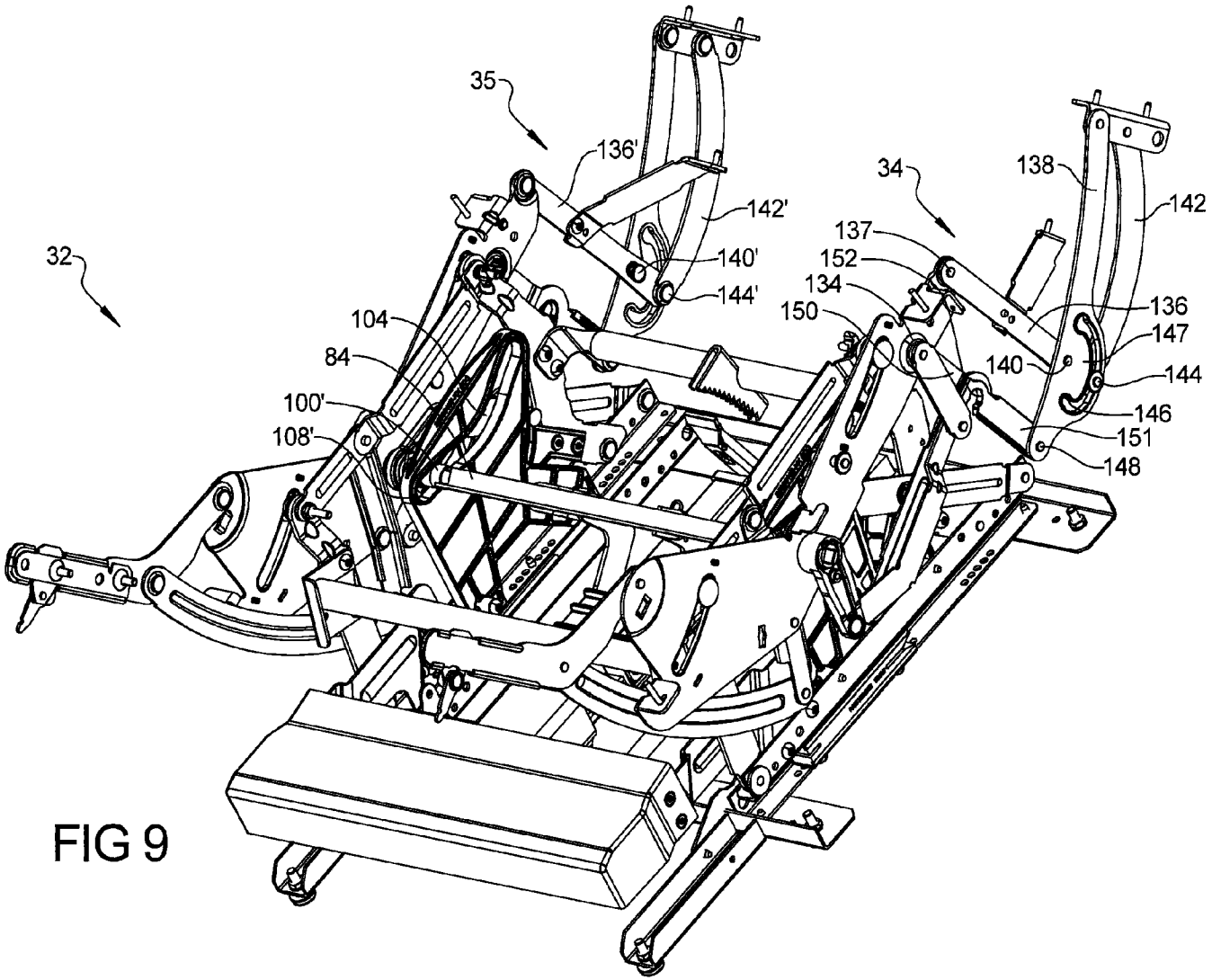
FIG. 9 is a rear right perspective view of the mechanism in a partially extended leg rest release position.

Referring to FIG. 9, each of the first and second pantograph linkage sets 34, 35 are shown in a release position which can occur as the first and second pantograph linkage sets 34, 35 are returning from an extended position toward the retracted position if contact is made by one or both of the first and second pantograph linkage sets 34, 34 or the leg rest assembly 24 (not shown in this view) with an object under the pantograph linkage sets or leg rest assembly 24. In the example shown in FIG. 9, drive rod 84 is moving rearwardly within first and second elongated channels 102, 104 and has nearly reached the first channel end wall 108, 108' which would normally establish the fully retracted position of the leg rest assembly.

Each of the first and second pantograph linkage sets 34, 35 are similarly constructed, therefore the following description of first pantograph linkage set 34 is equally applicable to second pantograph linkage set 35. A mechanism side plate 134 has a first pantograph link 136 rotatably connected to the mechanism side plate 134 using a pin 137. A leg rest support link 138 is rotatably connected to first pantograph link 136 using a pin 140. A leg rest angle control link 142 is also rotatably connected to first pantograph link 136 using a multiple connection pin 144. Multiple connection pin 144 is slidably disposed within an elongated U-shaped slot 146 created in an extended width portion 147 of leg rest support link 138. A pin 148 rotatably connects an end of leg rest support link 138 to a second pantograph link 150. A polymeric attachment 151 is attached to second pantograph link 150 which will be shown and described in greater detail in reference to FIGS. 14 and 15. An engagement slot 152 is provided in polymeric attachment 151 to permit release of the first pantograph linkage set 34 upon contact with an object during retraction of the pantograph linkage set 34.

Figure 10:
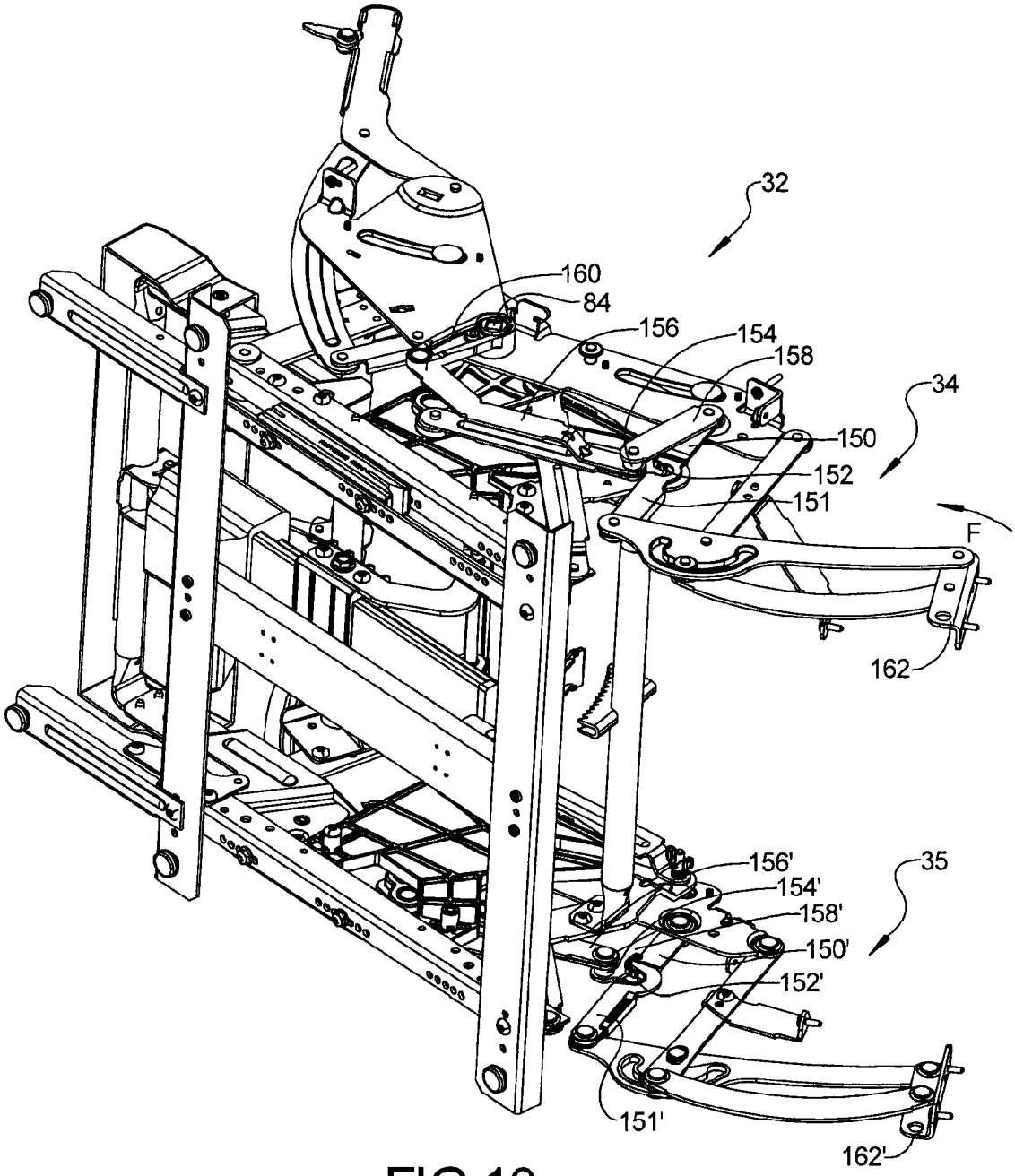
FIG. 10 is a bottom right perspective view of the mechanism of FIG. 9.

Referring to FIG. 10, engagement slot 152 normally receives and releasably captures an engagement pin 154, which is connected at a free end of an extension link 156. Engagement pin 154 is also rotatably connected at a free end of a carrier link 158. Engagement pin 154, when seated within engagement slot 152, permits normal extension and retraction of each of the first and second pantograph linkage sets 34, 35. When the engagement pin 154 releases out of (or freely away from) the engagement slot 152, the pantograph linkage set is thereafter freely rotatable with respect to extension link 156, which continues to be rotatably retracted to the leg rest retracted position by rotatable connection to a leg rest lock link 160. Leg rest lock link 160 is fixed to a free end of drive rod 84 such that rotation of drive rod 84 co-rotates the leg rest lock link 160. An orientation of engagement slot 152 is provided having an opening into the engagement slot facing rearward allowing extension link 156 to continue in powered motion in a rearward direction if engagement pin 154 is released from the engagement slot 152. When engagement pin 154 is disengaged from engagement slot 152, the pantograph linkage set 34 can either remain at its position due to an obstruction item 159 it has contacted or is thereafter free to gravity rotate toward the leg rest retracted position when the obstruction item is removed from under the pantograph linkage set. A force "F" applied to the leg rest assembly 24 through leg rest connection brackets 162, 162' (for example by the occupant) is thereafter required to reset engagement pin 154 into engagement with engagement slot 152, which will be described in further detail in reference to FIGS. 14 and 15. Carrier link 158 maintains a repeatable position of engagement pin 154 to permit re-engagement of engagement pin 154 within engagement slot 152.

Figure 11:
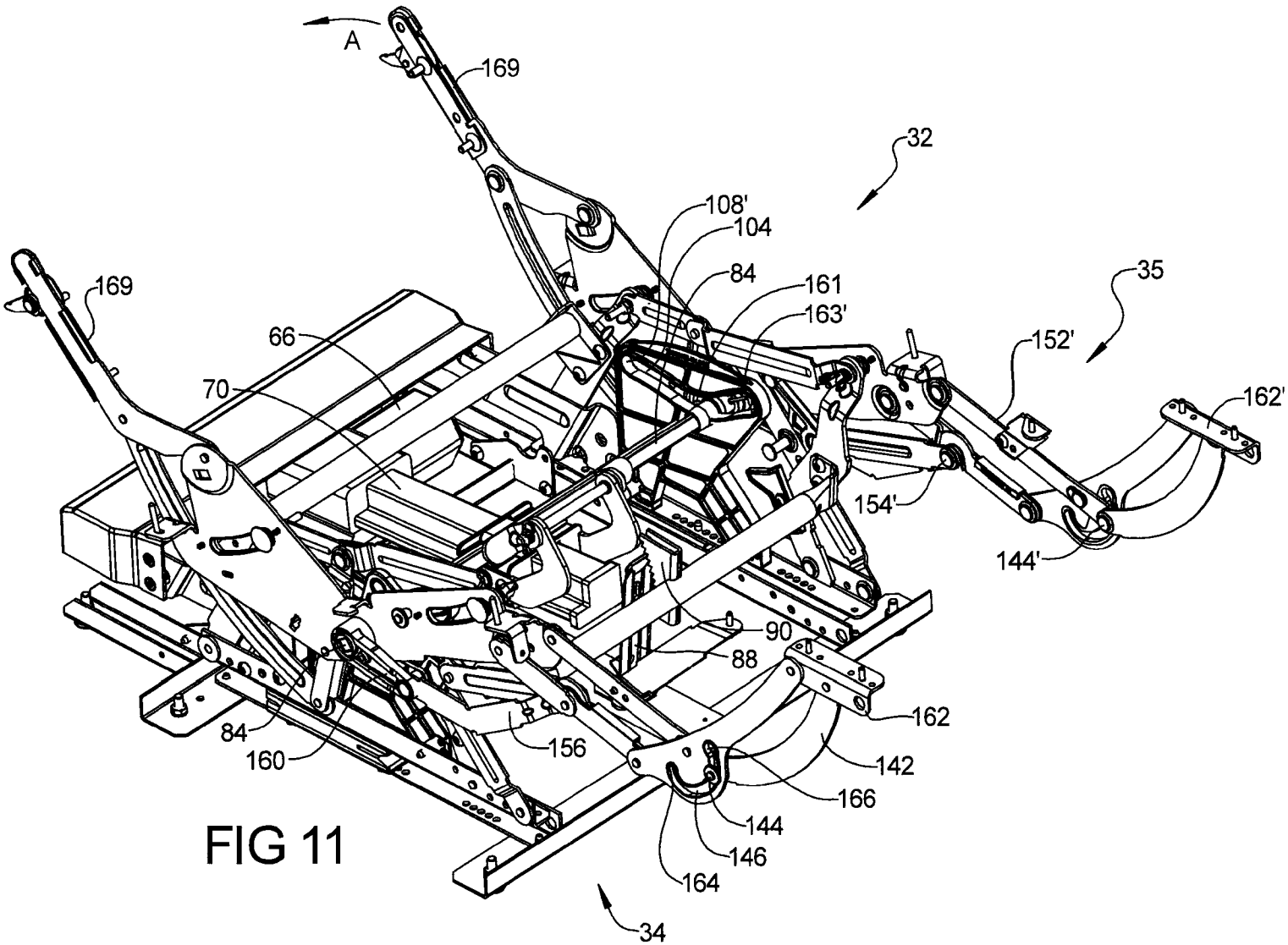
FIG. 11 is a top right perspective view of the mechanism in a leg rest fully extended position.

Referring to FIG. 11, a fully extended position of leg rest assembly 24 and first and second pantograph linkage sets 34, 35 is provided when drive rod 84 reaches a lowest elevation slot position 161 of first and second curved elongated channels 102, 104 (first curved elongated channel 102 is not clearly visible in this view). In the fully extended position, the multiple connection pin 144 is positioned furthest away from a first slot end wall 164 of the U-shaped slot 146 and closest to a second slot end wall 166 of the U-shaped slot 146. This positioning of multiple connection pin 144 extends leg rest angle control link 142 to a furthest forward position which fully rotates the first and second leg rest support arms 36, 37 and first and second leg rest connection brackets 162, 162'. The fully extended position of leg rest assembly 24 is reached when drive rod 84 fully rotates leg rest lock link 160 in a forward directed rotation which fully extends extension link 156 in a forward direction. Also in the fully extended position, engagement pin 154 is fully engaged within engagement slot 152 and maintained fully engaged by gravity plus the weight of the occupant's legs on leg rest assembly 24.

During extension of the leg rest assembly 24 from the retracted to the fully extended position, right and left seat back support members 168, 169 are maintained in a seat back upright orientation. Once the fully extended position of leg rest assembly 24 is reached, further rotation of drive assembly 66 and gear housing 70 no longer functions to axially rotate the drive rod 84, but instead forwardly translates drive rod 84 within first and second curved elongated channels 102, 104 from the lowest elevation slot position 161 until drive rod 84 is positioned proximate to or contacts a second channel end wall 163, 163' (second channel end wall 163 is not clearly visible in this view). Translation motion of drive rod 84 from the lowest elevation slot position 161 until positioned proximate to or in contact with second channel end wall 163, 163' generates a continuous rearward rotation of right and left seat back support members 168, 169 in a seat back arc of rotation "A".

To return from the fully extended position of leg rest assembly 24 to the fully retracted position, actuation mechanism 32 is operated in an opposite manner. Initially, with drive rod 84 in contact with second channel end wall 163, 163' downward rotation of drive assembly 66 and gear housing 70 results in translation in a rearward direction of drive rod 84 until drive rod 84 once again reaches the lowest elevation slot position 161. From this position, combined axial rotation and rearward translation of drive rod 84 again occurs from further downward rotation of drive assembly 66 and gear housing 70 which rotates leg rest lock links 160, 160' pulling extension links 156, 156' rearward and returning the pantograph linkage sets 34, 35 toward the retracted position. It is further noted that downward rotation of gear housing 70 after the leg rest fully extended position is reached causes disengagement of the pawl member 88 from ratchet 90 which permits rotation of the pantograph linkage sets 34, 35. It is also noted that first and second curved elongated channels 102, 104 define a generally V-shape configuration having the lowest elevation slot position 161 downwardly positioned with respect to each of the first channel end wall 108 and second channel end wall 163 positions.

Figure 12:
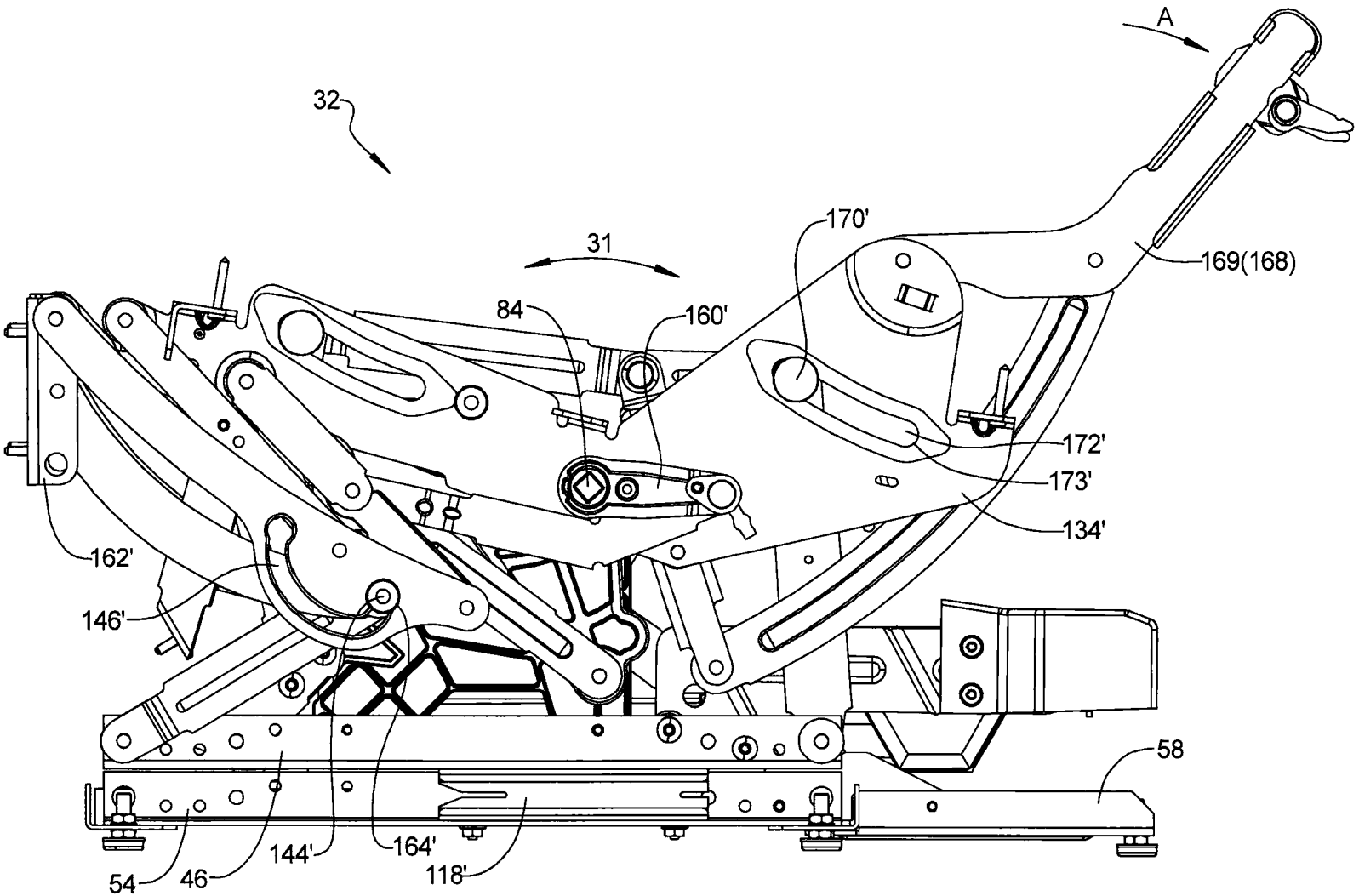
FIG. 12 is a left side elevational view of the mechanism in a leg rest fully retracted position.

Referring to FIG. 12, the fully retracted position of leg rest assembly 24 shown permits rocking motion of actuation mechanism 32 about furniture member arc of rotation 31. Right and left seat back support members 168, 169 (only left seat back support member 169 is visible in this view) are positioned in the seat back upright position and can move in the seat back arc of rotation "A" during powered actuation by sliding movement of a seat back motion pin 170, 170' within an elongated slot 172, 172' (seat back motion pin 170 and elongated slot 172 are not clearly visible in this view). Contact between the seat back motion pin 170' with a slot end wall 173 defines the fully rotated seat back position. As previously noted, positioning rocking motion biasing member 118' between left side support member 46 and left lateral frame member 54 permits rocking motion with respect to furniture member arc of rotation 31 of the components of actuation mechanism 32 which are positioned above left side support member 46. Occupant induced (non-powered) rocking motion of actuation mechanism 32 is permitted at least when leg rest assembly 24 is positioned in the fully retracted position and the right and left seat back support members 168, 169 are positioned in the seat back fully upright position shown, or after disengagement of pawl member 88 from ratchet 90 (shown and described with reference to FIG. 11) but before leg rest assembly 24 has completely returned to its fully retracted position. Frame extensions, such as left frame extension 58, provide additional support of actuation mechanism 32 for rearward rotation during rocking motion.

Figure 13:
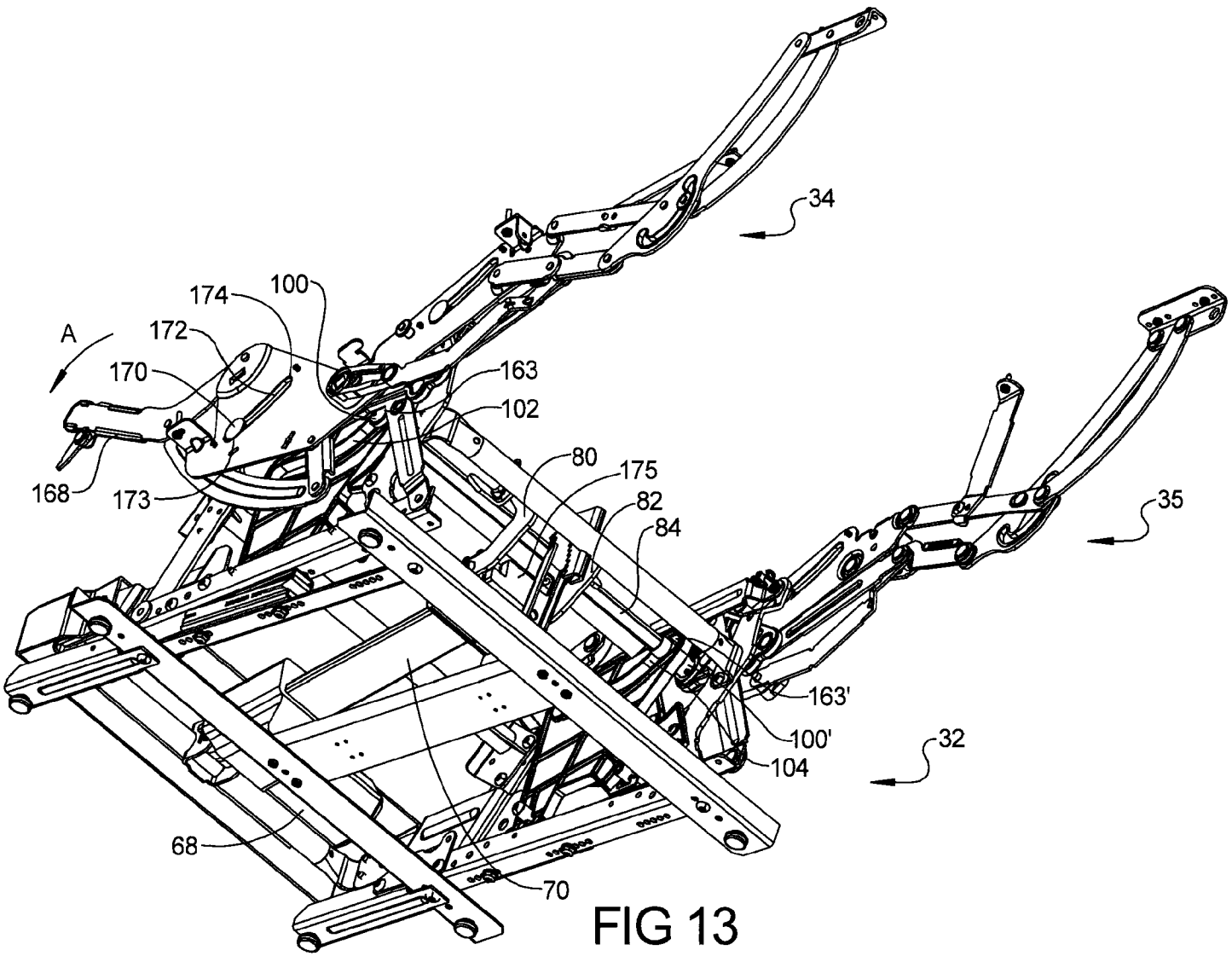
FIG. 13 is a bottom right perspective view of the mechanism in a leg rest fully extended and seat back fully reclined positions.

Referring to FIG. 13, actuation mechanism 32 is shown with leg rest assembly 24 in the fully extended position and right and left seat back support members 168, 169 rotated to the seat back fully rotated position achieved by rotation through seat back arc of rotation "A". Seat back motion pin 170 has translated away from contact with a second slot end wall 174 of elongated slot 172 and contacts slot end wall 173 in the seat back fully rotated position. Also in the seat back fully rotated position, the polymeric bushings 100, 100' contact the second channel end walls 163, 163' of each of the first and second curved elongated channels 102, 104. As most clearly seen in this view, both first and second rigid drive links 80, 82 are fixedly (such as by fastening) connected to a carriage assembly 175 which is longitudinally translated along and guided by gear housing 70 during operation of motor 68. Carriage assembly 175 reaches its fullest forward extension along gear housing 70 when the right and left seat back support members 168, 169 reach the seat back fully rotated position.

Referring again to FIGS. 1, 2, 6, 9 and 10, rocking furniture member 10 of the present disclosure therefore includes an actuation mechanism 32 including an extendable and retractable leg rest assembly 24. An electrically powered and occupant controlled drive assembly 66 connected to the actuation mechanism 32 operates upon receipt of a command from an occupant of the furniture member 10 to move the leg rest assembly 24 between a retracted position (shown in FIGS. 1 and 3 and any of a plurality of extended positions shown in FIGS. 2 and 9 inclusive including a fully extended position (shown in FIG. 11. An elastically deflectable polymeric material rotation member 118 is connected to the actuation mechanism 32 permitting an occupant induced rocking motion (about arc of rotation 31) of the actuation mechanism 32 at least when the leg rest assembly 24 is in the retracted position.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A rocking furniture member having an electrically powered actuation mechanism, comprising:

a frame;

an actuation mechanism connected to the frame, the actuation mechanism including an extendable and retractable leg rest assembly;

an electrically powered drive assembly connected to the actuation mechanism operating to move the leg rest assembly between retracted and extended positions; and a rotation member of a resilient polymeric material positioned between the actuation mechanism and the frame permitting an occupant induced rocking motion of the actuation mechanism with respect to the frame at least when the leg rest assembly is in the retracted position.

2. The rocking furniture member of claim 1, wherein the rotation member defines a rectangular shape.

3. The rocking furniture member of claim 1, wherein the actuation mechanism includes a drive rod movable by the drive assembly to extend and retract the leg rest assembly.

4. The rocking furniture member of claim 1 wherein the actuation mechanism includes:

a drive rod movable by the drive assembly to extend and retract the leg rest assembly;

at least one drive link fixedly connected to the drive assembly; and a drive rod connecting link fixedly connected to the drive rod and rotatably connected to the at least one drive link, the drive rod connecting link permitting both axial rotation and forward and rearward translation of the drive rod.

5. The rocking furniture member of claim 1, wherein the drive assembly is rotatably connected to the actuation mechanism by a single pin.

6. A rocking furniture member having an electrically powered actuation mechanism, comprising:

a frame;

an actuation mechanism connected to the frame, the actuation mechanism including an extendable and retractable leg rest assembly;

an electrically powered drive assembly connected to the actuation mechanism operating to move the leg rest assembly between retracted and extended positions; and a rotation member positioned between the actuation mechanism and the frame permitting an occupant induced rocking motion of the actuation mechanism with respect to the frame at least when the leg rest assembly is in the retracted position;

wherein the actuation mechanism includes a drive rod movable by the drive assembly to extend and retract the leg rest assembly and opposed sequencing plates each having an elongated channel individually receiving one end of the drive rod, the drive rod being axially rotated within the elongated channel of each of the sequencing plates during extension and retraction of the leg rest assembly.

7. The rocking furniture member of claim 6, further including a hinge pin assembly rotatably connecting the drive assembly to the actuation mechanism, wherein the drive rod is translated within the elongated channel of both sequencing plates coincident with axial rotation of the drive rod during extension and retraction of the leg rest assembly by rotation of the drive assembly about the hinge pin assembly.

8. A rocking furniture member having an electrically powered actuation mechanism, comprising:

a frame;

an actuation mechanism connected to the frame, the actuation mechanism including an extendable and retractable leg rest assembly;

an electrically powered drive assembly connected to the actuation mechanism operating to move the leg rest assembly between retracted and extended positions; and a rotation member positioned between the actuation mechanism and the frame permitting an occupant induced rocking motion of the actuation mechanism with respect to the frame at least when the leg rest assembly is in the retracted position; and a drive rod of the actuation assembly movable by the drive assembly to extend and retract the leg rest assembly;

wherein the drive assembly includes:

a gear housing rotatably connected to the actuation mechanism; and a carriage assembly slidably translatable with respect to the gear housing, the drive rod connected to the carriage assembly such that a rotational movement of the gear housing during sliding translation of the carriage assembly causes both the axial rotation and translation of the drive rod.

9. A rocking furniture member having an electrically powered actuation mechanism, comprising:

a frame;

an actuation mechanism connected to the frame, the actuation mechanism including an extendable and retractable leg rest assembly;

an electrically powered drive assembly connected to the actuation mechanism operating to move the leg rest assembly between retracted and extended positions; and a rotation member positioned between the actuation mechanism and the frame permitting an occupant induced rocking motion of the actuation mechanism with respect to the frame at least when the leg rest assembly is in the retracted position;

wherein the actuation mechanism includes:

a drive rod movable by the motorized drive assembly to extend and retract the leg rest assembly; and opposed sequencing plates each having an elongated channel individually receiving one end of the drive rod, the drive rod translating within the elongated channel of both sequencing plates coincident with axial rotation of the drive rod during extension and retraction of the leg rest assembly.

10. The rocking furniture member of claim 9, wherein the actuation mechanism includes first and second end walls of the elongated channel of each sequencing plate and a lowest elevation slot position positioned elevationally below both the first and second opposed end walls.

11. The rocking furniture member of claim 10, wherein:

the drive rod is positioned proximate to the first end wall with the leg rest assembly in the fully retracted position; and the leg rest assembly reaches the fully extended position when the drive rod is positioned at the lowest elevation slot position.

12. The rocking furniture member of claim 11, further comprising left and right seat back support members positioned between a fully upright position and a fully reclined position inclusive, the seat back support members being positioned in the fully upright position until the drive rod reaches the lowest elevation slot position after which further actuation of the drive assembly displaces the drive rod without axial rotation from the lowest elevation slot position toward the second end wall, the seat back support members positioned in the fully reclined position when the drive rod is positioned proximate to or in contact with the second end wall.

13. A rocking furniture member having an electrically powered actuation mechanism, comprising:

a frame;

an actuation mechanism connected to the frame, the actuation mechanism including an extendable and retractable leg rest assembly;

a drive assembly connected to the actuation mechanism having an electric motor operating to move the leg rest assembly between a retracted position and any of a plurality of extended positions inclusive including a fully extended position by a command provided by an occupant of the furniture member;

a rotation member connecting the actuation mechanism to the frame permitting an occupant induced rocking motion of the actuation mechanism with respect to the frame at least when the leg rest assembly is in the retracted position;

a pantograph link of the leg rest assembly rotatably connected to the mechanism, the pantograph link having an engagement slot; and an engagement pin connected to an extension link, the engagement pin releasably received in the engagement slot to extend and retract the pantograph link and thereby the leg rest assembly when the extension link is displaced;

wherein when an obstruction item in a return path of the leg rest assembly returning toward the fully retracted position is contacted, an orientation of the engagement slot permits release of the engagement pin from the engagement slot allowing the leg rest assembly to return by gravity toward the fully retracted position after removal of the obstruction item from the return path.

14. The rocking furniture member of claim 13, wherein the actuation mechanism further includes a drive rod movable by the drive assembly to extend and retract the leg rest assembly the drive rod rotatably connected to the extension link.

15. The rocking furniture member of claim 14, wherein the actuation mechanism further includes opposed sequencing plates each having an elongated channel individually receiving one end of the drive rod, the drive rod translating within the elongated channel of both sequencing plates coincident with axial rotation of the drive rod during extension and retraction of the leg rest assembly.

16. A rocking furniture member having an electrically powered actuation mechanism, comprising:

a frame;

an actuation mechanism connected to the frame, the actuation mechanism including an extendable and retractable leg rest assembly;

a drive assembly connected to the actuation mechanism having an electric motor operating to move the leg rest assembly between a retracted position and any of a plurality of extended positions inclusive including a fully extended position by a command provided by an occupant of the furniture member;

a rotation member connecting the actuation mechanism to the frame permitting an occupant induced rocking motion of the actuation mechanism with respect to the frame at least when the leg rest assembly is in the retracted position;

a pantograph link of the leg rest assembly rotatably connected to the mechanism, the pantograph link having an engagement slot;

an engagement pin connected to an extension link, the engagement pin releasably received in the engagement slot to extend and retract the pantograph link and thereby the leg rest assembly when the extension link is displaced; and a polymeric attachment frictionally connected to the pantograph link.

17. The rocking furniture member of claim 16, wherein the polymeric attachment includes a semi-spherical shaped wall inner face defining the engagement slot.

18. The rocking furniture member of claim 16, wherein the polymeric attachment further includes at least one raised shoulder defining a clearance span smaller than a diameter of the engagement slot such that insertion of the engagement pin into the engagement slot requires elastic deformation of the at least one raised shoulder.

19. The rocking furniture member of claim 17, wherein the polymeric semi-spherical shaped wall inner face defines an arc greater than 180 degrees.

* * * * *